United States Patent [19]

Robson et al.

[11] 4,132,017

[45] Jan. 2, 1979

[54] BLADE FOR EARTH MOVING EQUIPMENT

[75] Inventors: Ernest G. Robson, Christchurch; George A. M. Smith, Poole, both of England

[73] Assignee: National Research Development Corporation, London, England

[21] Appl. No.: 714,326

[22] Filed: Aug. 13, 1976

[51] Int. Cl.[2] ..... E02F 5/00

[52] U.S. Cl. ..... 37/141 R; 37/42 VL

[58] Field of Search ..... 37/141 T, 141 R, 117.5, 37/103, 42 VL, DIG. 18; 172/40

[56] References Cited

U.S. PATENT DOCUMENTS

| | | | |
|---|---|---|---|
| 3,305,953 | 2/1967 | von Mehren et al. | 37/142 R |
| 3,328,904 | 7/1967 | Voigt et al. | 37/142 R |
| 3,387,890 | 6/1968 | Haynes | 37/141 T |
| 3,436,849 | 4/1969 | Haynes | 37/141 R |
| 3,478,450 | 11/1969 | Cunningham | 37/141 R |
| 3,512,284 | 5/1970 | Haynes | 37/141 R |
| 3,828,951 | 8/1974 | Fleming | 37/141 T X |
| 3,867,987 | 2/1975 | Seaberg | 172/40 |
| 3,889,405 | 6/1975 | Rawini | 37/141 R |

FOREIGN PATENT DOCUMENTS

| | | | |
|---|---|---|---|
| 933887 | 9/1973 | Canada | 37/141 R |
| 1291227 | 10/1972 | United Kingdom | 37/141 R |
| 1416860 | 12/1975 | United Kingdom | 37/141 R |
| 165937 | 11/1963 | U.S.S.R. | 172/140 |

*Primary Examiner*—E. H. Eickholt

*Attorney, Agent, or Firm*—Cushman, Darby & Cushman

[57] ABSTRACT

A blade for an earth moving machine mounted in the machine as to have at least one strip extending forward of the leading edge to engage and cut the soil by an oscillatory movement about an axis close to and parallel to the leading edge. A spading action is thereby produced which aids penetration of the blade into the soil so as to enable the soil to be more easily cut and shifted. The invention is applicable to many different kinds of earth moving machinery which cut and shift soil and increases the efficiency of earth moving machinery by increasing the soil cutting and moving ability attainable without relying on high tractive effort or increased power output.

4 Claims, 2 Drawing Figures

BLADE FOR EARTH MOVING EQUIPMENT

Figure 1:
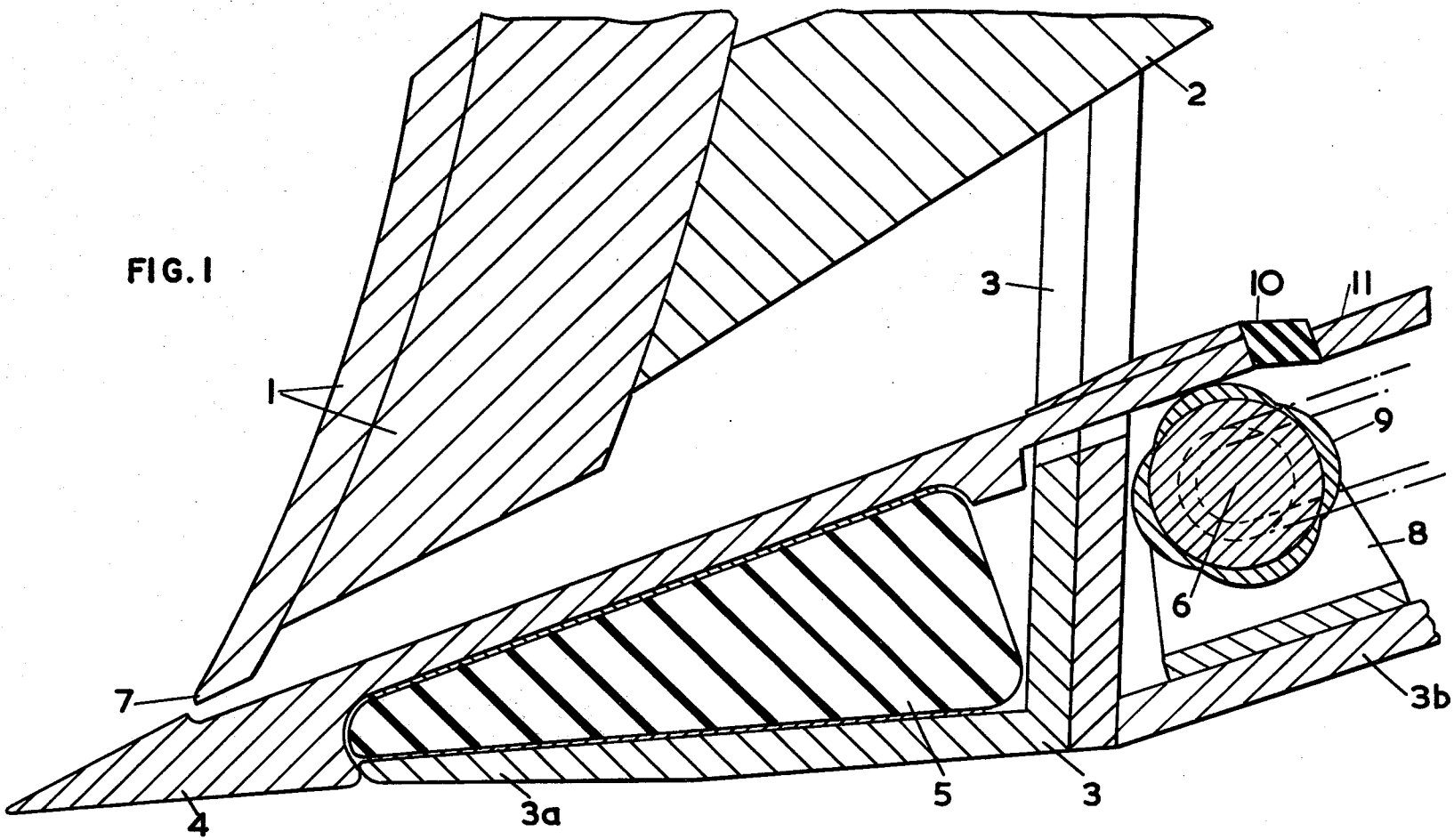

This invention relates to earth moving equipment employing an earth working blade to cut the soil as to enable it subsequently to be shifted. Many kinds of earth moving equipment are included within this general category, e.g. vehicles such as bulldozers, angledozers, scrapers, tractor shovels, wheeled loaders, earth moving buckets, grabs, and even possibly graders, and all other earth moving equipment employing a blade which has a cutting action on the soil. The fundamental design of such equipment has changed little in recent years, and increase in performance has mainly been achieved by employing larger or more powerful machines, to give increased tractive effort or otherwise to apply an increased cutting force to the soil. Observations indicate, however, that the larger the machine the less the tractive effort and output per ton weight of machine. Furthermore, the traction of a vehicle falls rapidly as ground conditions deteriorate, for example due to rain or other moisture, and this invention is aimed at improving the performance of earth moving equipment without relying on higher tractive effort or increased power output, by reducing the cutting force required at the blade.

This invention consists of an earth working blade for use on earth moving equipment, said blade having at least one strip extending forward of the leading edge of the blade and constituting at least one cutter, each cutter being arranged for oscillation about an axis substantially parallel to and close to said leading edge.

By the use of one or more cutters in this way, the blades can be made to simulate the action of a spade forced into the ground with to and fro motion to break the soil, and it has been demonstrated that such breaking-up and subsequent moving of heavy soils requires considerably less power than is required for example by a conventional bulldozer action, and consequently the employment of a much lighter and/or less powerful vehicle is possible.

There can be provided a single oscillating cutter, which can extend substantially the whole width of the blade, but preferably the invention takes the form of a blade incorporating a series of abutting cutters disposed along its leading edge and arranged to oscillate in a suitable pre-determined phase relationship to one another.

Each cutter can have a rearward extension on which means for oscillating the cutter can act. In a convenient arrangement the cutters, pivoted close to the edge of the blade, can be oscillated by moving the cutter extensions up and down. The pivots can comprise stub axles fixed to a frame by which the blade may be mounted on a vehicle, or can take the form of a resilient cushion of urethane or rubber, for example, bonded to the cutter rearwards of its leading edge and to a support member secured to the frame, the latter arrangement reducing friction between relatively moving parts.

The means for oscillating the cutter extensions can comprise hydraulic jacks acting directly on the cutter extensions to move them up and down. Alternatively, one or more rotating cams can be arranged to bear against the or each cutter extension or extensions and cause oscillatory movement of the cutters, in which case the relative phases of the oscillations of the cutters can be set by adjustment of the phase of the corresponding cam. In a preferred embodiment, the cams are mounted coaxially on a single shaft, the shaft being rotatable either directly by a motor or by connection through a belt or chain to a power source. Any suitable power source can be used, such as a hydraulic or mechanical take-off from the vehicle itself.

By way of example, one embodiment of the invention will now be described, with reference to FIG. 1 of the accompanying drawing, which is a section through part of a blade for a bulldozer or angledozer, of a first embodiment the blade having oscillating cutters according to the invention and to FIG. 2 which is a similar section of a second embodiment.

Referring to FIG. 1, a blade 1 for use with a bulldozer or angledozer is rigidly attached to a frame 2 which is movably attached to the vehicle (not shown) and is connected to lifting and lowering means on the vehicle (not shown). Also rigidly attached to the frame 2 is a support member 3 which extends the whole width of the blade 1.

A cutter 4, one of four identical ones mounted side by side across the width of the blade 1 is bonded across its width to one face of a resilient urethane cushion 5 the cushion being bonded on its other face to a forwardly extending part 3*a* of the support member 3.

A shaft 6 is mounted, parallel to the leading edge 7 of the blade 1, on bearings 8 fixed to a rearwardly extending part 3*b* of the support member 3. Four four-lobed rotary cams, such as 9, are equally spaced along the shaft 6 and mounted thereon so as to permit circumferential adjustment. Each of the cutters 4 has a rearward extension long enough to abut a corresponding cam 9, each cutter extension being urged into contact with its corresponding cam by the action of the urethane cushion 5 and of a flexible joint 10 connecting each cutter extension to a further support member 11.

Rotation of the shaft 6, preferably by a hydraulic motor actuated from the power take-off of the vehcile, causes oscillation of the forward portion of each cutter in a vertical plane, each rotation of the shaft corresponding to four cycles of oscillation. The orientation of each cam upon the shaft 6, and hence the phase of oscillation of the corresponding cutter, can be adjusted as required. Preferably, to minimise lateral forces, the oscillations of the four cutters are arranged to be either in phase or in a symmetrical phase relationship such as 0°-180°-180°-0°.

Figure 2:
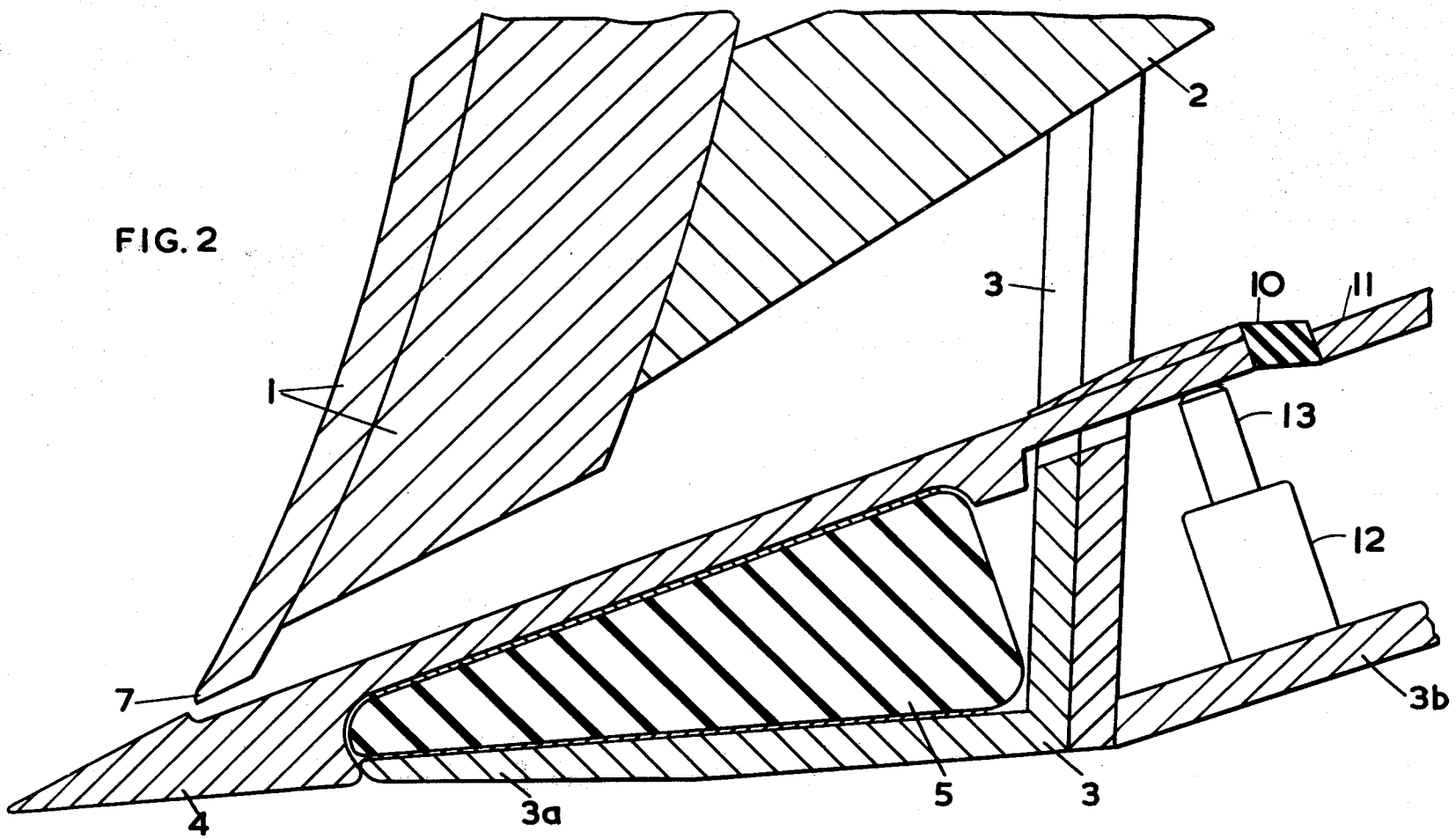

Alternatively, as shown in FIG. 2, the cam arrangement just described can be replaced by hydraulic jacks each comprising a body 12 mounted on the rearwardly extending part 3*b* and a ram 13 which can act on the rearward extension of a corresponding cutter. Hydraulic power can be supplied by means (not shown) to drive the jacks and their associated cutters to cause oscillation of the forward part of each cutter 4 in a similar manner to the cams 9.

It will be evident that many alterations in detail to the above design can be made without altering the operating principles involved; thus the number of cutters may be any convenient number, not necessarily four; and the number of cutter oscillations per shaft rotation need not be four, as cams of any pattern may be incorporated provided that the blade extensions can follow the rotating cam surface. Spring means may be used to urge the rearwardly extending cutter extensions on to the cam surfaces, or to replace the resilient cushion, in which latter case the cutters would be rotatably pinned to the support member.

We claim:

1. An earth working blade having a leading edge for use on earth moving equipment having at least one strip extending forward of said leading edge of the blade and constituting a plurality of abutting cutters disposed along said leading edge and arranged for oscillation in a pre-determined phase relationship to one another, each cutter being provided with a rearward extension, a frame for securing said blade on a vehcile, and means for mounting each cutter for oscillation about an axis fixed with respect to said leading edge substantially parallel to and close to the said leading edge whereby the cutter penetrates material to be worked by means of spading action, means acting on said rearward extension for oscillating each cutter, a support member secured to said frame, and a resilient cushion bonded to each cutter rearwards of its leading edge and to said support member.

2. An earth working blade as claimed in claim 1 which the means for oscillating each cutter comprises a rotating cam arranged to bear against the rearward extension of each cutter.

3. An earth working blade as claimed in claim 2 in which the said cams are mounted coaxially on a single shaft mounted on the support member, the shaft being rotatable by a suitable power source.

4. An earth working blade as claimed in claim 1 in which the means for oscillating each cutter comprises a hydraulic jack arrangement acting against the rearward extension of each cutter to move it up and down.

* * * * *